United States Patent [19]

MacDuff et al.

[11] Patent Number: 4,596,672

[45] Date of Patent: Jun. 24, 1986

[54] DETERGENT COMPOSITIONS

[75] Inventors: Malcolm G. J. MacDuff; Appaya R. Naik, both of Merseyside; Melvin Scott, Cheshire, all of England

[73] Assignee: Lever Brothers Company, New York, N.Y.

[21] Appl. No.: 747,395

[22] Filed: Jun. 21, 1985

Related U.S. Application Data

[63] Continuation of Ser. No. 551,458, Nov. 14, 1983, abandoned.

[30] Foreign Application Priority Data

Nov. 16, 1982 [GB] United Kingdom ..... 8232688

[51] Int. Cl.[4] ..... C11D 1/28; C11D 1/83

[52] U.S. Cl. ..... 252/544; 252/545; 252/546; 252/550; 252/559; 252/DIG. 13; 252/DIG. 14

[58] Field of Search ..... 252/525, 527, 544, 546, 252/550, 551, 553, 558, 559, DIG. 14, DIG. 13

[56] References Cited

U.S. PATENT DOCUMENTS

| | | | |
|---|---|---|---|
| 3,629,127 | 12/1971 | Palmer et al. | 252/527 |
| 4,061,586 | 12/1977 | Klisch et al. | 252/544 |
| 4,072,632 | 2/1978 | Reed | 252/541 |
| 4,434,088 | 2/1984 | Billington et al. | 252/550 |
| 4,434,089 | 2/1984 | Billington et al. | 252/550 |

FOREIGN PATENT DOCUMENTS

| | | |
|---|---|---|
| 71413 | 2/1983 | European Pat. Off. . |
| 71414 | 2/1983 | European Pat. Off. . |
| 56-038395 | 4/1981 | Japan . |
| 57-65798 | 4/1982 | Japan . |
| 57-185397 | 11/1982 | Japan . |
| 818158 | 8/1959 | United Kingdom . |
| 1033289 | 6/1966 | United Kingdom . |
| 1155789 | 6/1969 | United Kingdom . |
| 2262105 | 12/1977 | United Kingdom . |
| 2010892 | 6/1982 | United Kingdom . |
| 2105325 | 3/1983 | United Kingdom . |
| 2104913 | 3/1983 | United Kingdom . |
| 2108520 | 5/1983 | United Kingdom . |
| 740820 | 6/1980 | U.S.S.R. . |

OTHER PUBLICATIONS

Chem. Abs. 82 1975 74812 (Russian Journal Article: Maslo-Zhir. Prom. St. 1974 (9) pp. 21-22).

*Primary Examiner*—Paul Lieberman
*Assistant Examiner*—Hoa Van Le
*Attorney, Agent, or Firm*—Milton L. Honig; James J. Farrell

[57] ABSTRACT

In a foaming liquid detergent composition suitable inter alia for hand dishwashing and including in its detergent-active system a dialkyl sulphosuccinate, performance is enhanced and physical characteristics (stability, viscosity, hydrotrope requirement) are improved by the inclusion of a fatty acid dialkanolamide such as lauric diethanolamide.

13 Claims, No Drawings

DETERGENT COMPOSITIONS

This is a continuation application of Ser. No. 551,458, filed Nov. 14, 1983, now abandoned.

The present invention relates to high-foaming liquid detergent compositions suitable for use in fabric washing, shampoos, and above all, in manual dishwashing operations in both hard and soft water.

The term "dishes" as used herein means any utensils involved in food preparation or consumption which may be required to be washed to free them from food particles and other food residues, greases, proteins, starches, gums, dyes, oils and burnt organic residues.

The present invention is based on the observation that in liquid detergent compositions based on dialkyl sulphosuccinates in combination with certain other surfactants, the performance and the physical characteristics (viscosity, cloud point, hydrotrope requirement) are improved by the presence of small quantities of fatty acid dialkanolamides. The effect is not obtained with monoalkanolamides.

The use of dialkyl sulphosuccinates as active detergents in liquid compositions suitable inter alia for manual dishwashing is disclosed, for example, in GB 1 429 637, GB 2 108 520, GB 2 104 913, GB 2 105 325, EP 71413 and EP 71414 (Unilever).

Fatty acid mono and dialkanolamides, in particular coconut monoethanolamide and lauric diethanolamide, are well-known as lather boosters or lather promoters in liquid detergent compositions.

J5 71 85397 (Kaneyo Sekken KK) discloses a liquid detergent composition containing a $C_6$–$C_{18}$ monoalkyl or dialkyl sulphosuccinate (preferably dioctyl sulphosuccinate), a fatty acid alkanolamide (preferably coconut diethanolamide), a mineral abrasive and, optionally, an amine oxide.

J5 70 65798 (Nippon Shokubai Kagaku) discloses a composition containing an ethoxylated monoalkyl sulphosuccinate, a random secondary alcohol ethoxy sulphate, and an alkyl mono- or diethanolamide.

The present invention provides a foaming liquid detergent composition in the form of a stable aqueous solution containing at least 5% by weight of an active detergent mixture comprising:

(a) a water-soluble salt of a dialkyl ester of sulphosuccinic acid in which the alkyl groups may be the same or different, in an amount of at least 2% by weight based on the total composition, (b) an alkyl ether sulphate and/or a polyethoxylated nonionic surfactant, and (c) a $C_{10}$–$C_{18}$ carboxylic acid di($C_2$–$C_3$) alkanolamide, in an amount not exceeding 30% by weight based on the active detergent mixture.

Surprisingly, the use of the dialkanolamide (c) enhances the foaming performance of dialkyl sulphosuccinate-based compositions in both hard and soft water, and also yields improvements in cloud point and reduces hydrotrope and viscosity requirements, whereas the performance of compositions based predominantly on alkylbenzene sulphonates is decreased except in very soft (0° H) water. The performance of dialkyl sulphosuccinate-based compositions is not similarly enhanced by the addition of cocomonoethanolamide; on the contrary, there is a noticeable decrease in performance.

The liquid detergent composition of the invention contains three essential components (a), (b) and (c) in its active detergent system. As discussed below, additional detergent-active ingredients may also be present if desired. Although in principle the concentration of the active detergent mixture may be as high as desired, provided that an aqueous solution can be obtained, the range of 5 to 60% by weight is preferred and the range of 5 to 40% by weight is of especial interest.

The first essential ingredient (a) of the composition of the invention is a salt of a dialkyl ester of sulphosuccinio acid, hereinafter referred to as a dialkyl sulphosuccinate. This may if desired be constituted by a mixture of materials of different chain lengths, of which the individual dialkyl sulphosuccinates themselves may be either symmetrical (both alkyl groups the same) or unsymmetrical (with two different alkyl groups).

The detergent-active dialkyl sulphosuccinates are compounds of the formula I:

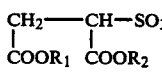

$$\begin{array}{l} CH_2 — CH — SO_3X_1 \\ \quad | \qquad\quad | \\ COOR_1 \quad COOR_2 \end{array} \qquad [I]$$

wherein each of $R_1$ and $R_2$, which may be the same or different, represents a straight-chain or branched-chain alkyl group having from 3 to 12 carbon atoms, preferably from 4 to 10 carbon atoms and more preferably from 6 to 8 carbon atoms, and $X_1$ represents a solubilising cation, that is to say, any cation yielding a salt of the formula I sufficiently soluble to be detergent-active. The solubilising cation $X_1$ will generally be monovalent, for example, alkali metal, especially sodium; ammonium; or substituted ammonium, for example, ethanolamine. Certain divalent cations, notably magnesium, are however also suitable.

The alkyl groups $R_1$ and $R_2$ are preferably straight-chain or (in mixtures) predominantly straight-chain.

Among dialkyl sulphosuccinates that may advantageously be used in the composition of the invention are the $C_6/C_8$ unsymmetrical materials described and claimed in GB 2 105 325 (Unilever); the dioctyl sulphosuccinate/dihexyl sulphosuccinate mixtures described and claimed in GB 2 104 913 (Unilever); and the mixtures of symmetrical and unsymmetrical dialkyl sulphosuccinates described and claimed in GB 2 108 520 (Unilever).

The dialkyl sulphosuccinate preferably constitutes at least 5% of the total composition. It is preferably the predominant component in the active detergent mixture.

If desired the composition of the invention may additionally include one or more of the sulphonate-type detergents conventionally used as the main detergent-active agent in liquid compositions, for example, alkylbenzene sulphonates (especially $C_9$–$C_{15}$ linear alkylbenzene sulphonates), secondary alkane sulphonates, alpha-olefin sulphonates, alkyl glyceryl ether sulphonates, and fatty acid ester sulphonates. Of course dialkyl sulphosuccinates are themselves sulphonate-type detergents. If such additional sulphonate-type materials are present, the total sulphonate preferably predominates in the active detergent mixture of the composition of the invention.

If desired there may also be present one or more primary or secondary alkyl sulphates. If present, these together with any sulphonate material as mentioned above, including the dialkyl sulphosuccinate, preferably predominate in the active detergent mixture of the composition of the invention.

The second essential component of the active detergent mixture is an alkyl ether sulphate and/or a polyethoxylated nonionic detergent.

Preferred alkyl ether sulphates are materials of the general formula II:

$$R_3—O—(CH_2CH_2O)_n—SO_3X_2 \quad [II]$$

wherein $R_3$ is a $C_{10}$ to $C_{18}$ alkyl group, $X_2$ is a solubilising cation, and n, the average degree of ethoxylation, is from 1 to 12, preferably 1 to 8. $R_3$ is preferably a $C_{11}$ to $C_{15}$ alkyl group. In any given alkyl ether sulphate, a range of differently ethoxylated materials, and some unethoxylated material, will be present and the value of n represents an average. The unethoxylated material is, of course, alkyl sulphate. If desired, additional alkyl sulphate may be admixed with the alkyl ether sulphate, to give a mixture in which the ethoxylation distribution is more weighted towards lower values.

It is especially preferred, according to the present invention, to use primary alkyl ether sulphates containing less than 20% by weight of $C_{14}$ and above material, as described and claimed in our copending application of even date claiming priority from British patent application No. 82 32686 filed on Nov. 16, 1982. Such material preferably has a degree of ethoxylation of 1 to 8.

Examples of preferred ether sulphates for use in the present invention are Dobanol (Trade Mark) 23-2, 23-3 and 23-6.5 ex Shell, all based on $C_{12}$–$C_{13}$ (50% of each) primary alcohol (about 75% straight chain, 25% 2-methyl branched), and having average degrees of ethoxylation n of 2, 3 and 6.5 respectively.

Additionally or alternatively component (b) may comprise a polyethoxylated nonionic detergent having an alkyl chain length of from $C_8$ to $C_{15}$ and an average degree of ethoxylation of from 5 to 14. Suitable nonionic detergents include short-chain high-foaming ethoxylated alcohols of the general formula III:

$$R_4—O—(CH_2CH_2O)_m—H \quad [III]$$

wherein $R_4$ is an alkyl group, preferably straight-chain, having from 8 to 12 carbon atoms, and the average degree of ethoxylation m is from 5 to 12. An especially preferred nonionic detergent is Dobanol 91-8 ex Shell, in which $R_4$ is $C_9$–$C_{11}$ (predominantly straight-chain) and m is 8.

The ratio of dialkyl sulphosuccinate, plus any other sulphonate-type detergent present plus any alkyl sulphate present other than that intrinsically present in ether sulphates, to the ether sulphate and/or nonionic detergent is preferably within the range of from 5:1 to 0.5:1, more preferably from 3:1 to 1:1.

The weight ratio of alkyl ether sulphate to nonionic detergent, if both are present, is preferably at least 1:1 and more preferably within the range of from 1.5:1 to 3:1, especially about 2:1.

Component (c) of the active detergent mixture of the composition of the invention is a $C_{10}$–$C_{18}$ carboxylic acid di($C_2$–$C_3$) alkanolamide. These are materials of the general formula IV:

$$R_5—CO—N(R_6)_2 \quad [IV]$$

wherein $R_5$ is a $C_{10}$–$C_{18}$ aliphatic group, preferably straight-chain and preferably saturated, and $R_6$ is a hydroxyethyl or hydroxypropyl group. $R_6$ is preferably a 2-hydroxyethyl group.

Materials of this type are generally of natural origin and contain a range of molecules having $R_5$ groups of different chain lengths; for example, coconut diethanolamides consist predominantly of $C_{12}$ and $C_{14}$ material, with varying amounts of $C_8$, $C_{10}$ and $C_{16}$ material.

For the purpose of foaming performance enhancement, the dialkanolamide component in the compositions of the invention preferably contains at least 75% by weight of $C_{12}$ and $C_{14}$ material and less than 1% of $C_{16}$ and higher-chain-length material. The approximate chain length distribution of some commercially available coconut-derived diethanolamides is shown below:

| | $C_8$ | $C_{10}$ | $C_{12}$ | $C_{14}$ | $C_{16}$ |
|---|---|---|---|---|---|
| LDEA** | 5 | 4 | 68 | 21 | <1 |
| Ninol* P621 | 0 | 0.8 | 70 | 29 | 0.12 |
| Ninol* AA-62 Extra | — | 1.1 | 97.5 | 1.0 | — |
| Empilan* CDE | 10 | 7 | 49 | 17 | 7 |

*Trade Mark
**Narrow-cut coconut diethanolamide

Empilan CDE is ex Albright and Wilson, and the Ninols are ex Stepan Chemical Co.

Of these materials, Empilan CDE gives the least enhancement of foaming performance in compositions according to the invention, but all types of diethanolamide are effective in lowering cloud points and increasing viscosities.

For performance reasons, the amount of dialkanolamide present in the compositions of the invention does not exceed 30% by weight of the total active detergent mixture, and preferably does not exceed 25% by weight.

As well as active detergents (preferably from 5 to 60% by weight) and water, the liquid detergent compositions of the invention will generally need to contain one or more hydrotropes. Hydrotropes are materials present in a formulation to control solubility, viscosity, clarity and stability, but which themselves make no active contribution to the performance of the product. Examples of hydrotropes include lower aliphatic alcohols, especially ethanol; urea; lower alkylbenzene sulphonates such as sodium toluene and xylene sulphonates; and combinations of these. Hydrotropes are expensive and take up room in a formulation without contributing to its performance, and it is therefore desirable to use as small quantities of them as possible. As indicated previously the present invention enables substantially reduced amounts of hydrotropes to be used.

The compositions of the invention may also contain the usual minor ingredients such as perfume, colour, preservatives and germicides.

The stable liquid detergent compositions of the invention may be used for all normal detergent purposes where foaming is advantageous, for example, fabric washing products, general purpose domestic and industrial cleaning compositions, carpet shampoos, car wash products, personal washing products, shampoos, foam bath products, and, above all, manual dishwashing.

The invention is further illustrated by the following non-limiting Examples.

EXAMPLES

In the Examples the foaming performances of various formulations were compared using a plate washing test. In the test, plates soiled with a standard starch/fat/fatty acid mixture were washed in a standard manner with 5 liters of test solution (total concentration of the product 1 g/liter in 5° H. or 24° H. (French hardness) water at 45° C.) in a bowl, until only a third of the surface of the solution in the bowl was covered with foam. The number of plates washed before this arbitrary end-point was reached was taken as an indicator of dishwashing and foaming performance.

EXAMPLES 1 and 2

The foaming performances of various compositions containing dialkyl sulphosuccinate and alkyl ether sulphate in a 4:1 weight ratio, in the presence and absence of lauric diethanolamide and cocomonoethanolamide, were compared. In each case, the total active detergent concentration (including the ethanolamide materials) was kept constant at 25% and the ethanolamide materials, where present, partially replaced the other detergent-active materials.

The dialkyl sulphosuccinate used was a statistical mixture (mole ratio 1:2:1) of di-n-octyl sulphosuccinate, n-hexyl n-octyl sulphosuccinate and di-n-hexyl sulphosuccinate (sodium salts), prepared from a 1:1 mixture of n-hexanol and n-octanol by the method described in Example 1 of GB 2 108 520 (Unilever).

The ether sulphate used was Dobanol 23-3A ex Shell (50% $C_{12}$, 50% $C_{13}$; n=3; ammonium salt).

The lauric diethanolamide was a commercial narrow-cut coconut diethanolamide, referred to previously as LDEA, and the cocomonoethanolamide was Empilan CME ex Albright and Wilson.

The results were as follows:

| | A | 1 | 2 | B | C |
|---|---|---|---|---|---|
| Sulphosuccinate | 20 | 18.4 | 16.8 | 18.4 | 16.8 |
| Dobanol 23-3A | 5 | 4.6 | 4.2 | 4.6 | 4.2 |
| LDEA | — | 2.0 | 4.0 | — | — |
| (% of total a.d) | | (8.0) | (16.0) | | |
| Empilan CME | — | — | — | 2.0 | 4.0 |
| Plates test 24° H | 27 | 28 | 28 | 23 | 21 |
| 5° H | 34 | 33 | 36 | — | — |

It will be seen that Compositions 1 and 2 according to the invention had virtually identical foaming performance to that of the control A containing no alkanolamide material, while Compositions B and C containing cocomonoethanolamide had markedly inferior performances in hard water.

EXAMPLES 3 and 4

The procedure of Examples 1 and 2 was repeated at a 2:1 ratio of dialkyl sulphosuccinate to ether sulphate, still at a constant active detergent level of 25%. The ether sulphate used this time was Dobanol 23-2A, identical to Dobanol 23-3A except for its degree of ethoxylation (2 instead of 3).

The results were as follows:

| | D | 3 | 4 | E | F |
|---|---|---|---|---|---|
| Sulphosuccinate | 16.6 | 15.0 | 14.0 | 15.0 | 14.0 |
| Dobanol 23-2A | 8.3 | 7.5 | 7.0 | 7.5 | 7.0 |
| LDEA | — | 2.5 | 4.0 | — | — |
| (% of total a.d.) | | (10.0) | (16.0) | | |
| Empilan CME | — | — | — | 2.5 | 4.0 |
| Performance 24° H | 28 | 28 | 29 | 23 | 21 |
| 5° H | 31 | 30 | 30 | — | — |

It will be seen that the results, both in relative and in absolute terms, are very similar to those of Examples 1 and 2.

EXAMPLES 5 and 6

In this experiment the effect on cloud point, viscosity and foaming performance of adding mono- and diethanolamides to compositions containing 16% dialkyl sulphosuccinate (the $C_6/C_8$ mixture used in previous Examples) and 8% ether sulphate was investigated. The ether sulphates used were Debanol 23-3A and Dobanol 25-3A (based on $C_{12}$–$C_{15}$ primary alcohols, 25% of each chain length, about 75% linear and 25% 2-methyl branched, n=3, ammonium salt); the diethanolamides used were LDEA as in previous Examples and Ninol P-621 identified previously; and the monoethanolamide used was Empilan LME, similar to Empilan CME but containing a higher proportion (about 90%) of $C_{12}$ material. The results were as follows:

| | G | H | 5 | 6 | J | K |
|---|---|---|---|---|---|---|
| Sulphosuccinate | 16 | 16 | 16 | 16 | 16 | 16 |
| Dobanol 23-3A | 8 | 8 | 8 | 8 | 8 | — |
| Dobanol 25-3A | — | — | — | — | — | 8 |
| LDEA | — | — | 2 | — | — | — |
| Ninol P-621 | — | — | — | 4 | — | — |
| (% of a.d) | — | — | (7.7) | (14.3) | — | — |
| Empilan LME | — | — | — | — | 4 | 4 |
| Urea | 10 | 12 | 10 | 10 | — | — |
| Cloud point (°C.) | −0.5 | −8 | −5 | −3 | — | — |
| Viscosity (cp) | 156 | 138 | 235 | 178 | — | — |
| Plates test 24° H | 27 | 27 | — | 30 | 23 | 21 |
| 5° H | 33 | 33 | — | 36 | — | — |

Comparative Composition G, containing no ethanolamide material, gave an excellent plate-washing performance in both hard and soft water. With 10% urea as hydrotrope, however, its cloud point was only just below 0° C. Its viscosity was also rather low. The cloud point could be depressed by the inclusion of a further 2% urea (Comparative Composition H) but this also caused a slight drop in viscosity. Addition of 2% diethanolamide, on the other hand, simultaneously lowered the cloud point and raised the viscosity (Composition 5). Addition of more diethanolamide (Composition 6), while still beneficial, did not give correspondingly greater improvements in the physical properties of the composition, but the foaming performance of this composition was even better than that of the controls G and H. A corresponding composition J containing the same level (4%) of monoethanolamide had a reduced foaming performance, and that of composition K containing the broader-cut ether sulphate Dobanol 25-3A was further reduced. Compositions J and K were unstable at urea levels of 10 and 12%, separating into two phases, and so was a similar composition J' containing 2%, instead of 4%, of Empilan LME.

EXAMPLE 7

A similar exercise was carried out using lower levels of dialkyl sulphosuccinate (the $C_6/C_8$ material used in previous Examples) and ether sulphate and higher levels of the mono- and diethanolamide materials. The results are shown in the following Table. Replacement of the diethanolamide by the same level of monoethanolamide caused a drop in hard-water performance and a rise in cloud point. Comparative

| | 7 | L |
|---|---|---|
| Sulphosuccinate | 12 | 12 |
| Dobanol 23-3A | 6 | 6 |
| Ninol P-621 | 6 | — |
| (% of a.d.) | (25) | — |
| Empilan CME | — | 6 |
| Urea | 8 | 8 |
| Ethanol | — | 4 |
| Cloud point (°C.) | −7 | +2 |
| Plates test 24° H | 20 | 16 |

Composition L could be stabilised only by the addition of ethanol as a second hydrotrope.

EXAMPLE 8

In this experiment, the effect of adding diethanolamide to a 4:1 dialkyl sulphosuccinate/ether sulphate system was investigated. The dialkyl sulphosuccinate was the $C_6/C_8$ mixture used in previous Examples, and the ether sulphate was Dobanol 25-3A.

| | M | 8 |
|---|---|---|
| Sulphosuccinate | 20 | 20 |
| Dobanol 25-3A | 5 | 5 |
| LDEA | — | 2 |
| (% of a.d.) | — | (7.4) |
| Urea | 20 | 20 |
| Cloud point (°C.) | −7 | <−10 |
| Viscosity (cp) | 96 | 134 |

The cloud point was lowered, and the viscosity raised, by the addition of 2% diethanolamide.

EXAMPLES 9–11

Various compositions containing a relatively low (16%) total active detergent level and various proportions of diethanolamide were prepared. As expected these all had low viscosities, but the inclusion of diethanolamide was found to improve both viscosity and cloud point.

| | 9 | 10 | 11 |
|---|---|---|---|
| Sulphosuccinate | 11 | 10 | 8 |
| Dobanol 23-3A | 3 | 3 | 4 |
| Empilan CDE | 2 | 3 | 4 |
| (as % of a.d.) | (12.5) | (18.8) | (25.0) |
| Urea | 8 | 8 | 8 |
| Cloud point (°C.) | −4 | −5 | −7 |
| Viscosity (cp) | 23 | 44 | 50 |

EXAMPLES 12 and 13

In this experiment the effect of replacing the ether sulphate by a nonionic surfactant was explored. In each case, the total active detergent level was 24% and the diethanolamide represented 16.7% of the total. The nonionic surfactant was Dobanol 91-8 ex Shell ($C_9$–$C_{11}$ primary alcohol 8EO), the sulphosuccinate was the $C_6/C_8$ mixture used in previous Examples, and the other ingredients were as previously described and as shown in the following Table.

| | 12 | 13 |
|---|---|---|
| Sulphosuccinate | 13.3 | 13.3 |
| Dobanol 23-3A | 6.7 | — |
| Dobanol 91-8 | — | 6.7 |
| Ninol P-621 | 4.0 | 4.0 |
| Urea | 12.0 | 14.0 |
| Cloud point (°C.) | <−10 | −8 |
| Viscosity | 395 | 98 |
| Plates test 24° H | 28 | 24 |
| 5° H | 32 | 28 |

Composition 13 required a slightly higher level of hydrotrope, and had a lower viscosity. Its foaming performance was also slightly inferior.

EXAMPLES 14–19

In this experiment the effects of adding different diethanolamides, of different chain length distributions, to a 20%/8% dialkyl sulphosuccinate ether sulphate active detergent system was investigated. The diethanolamides tested were LDEA, Empilan CDE, Ninol P-621 and Ninol AA-62 Extra, which have been identified previously.

The results are shown in the following Table. Where only the performance was under test, fully formulated compositions containing hydrotrope were not prepared; the three fully formulated compositions (15, 18 and 19) that were prepared, each containing 4% of a different diethanolamide, all had very similar low cloud points and acceptable viscosities.

The performance results show an improvement as the percentage of $C_{12}$ and $C_{14}$ material in the diethanolamide increased and the percentage of $C_{16}$ and above material decreased. Empilan CDE, containing about 66% $C_{12}$ and $C_{14}$ and 7% $C_{16}$ and above, caused a small increase in performance (Composition 14) over that of the control (Composition N) at the 2% level, but at the 4% level the performance fell again (Composition 15) below that of the control. LDEA (89% $C_{12}$ and $C_{14}$, less than 1% $C_{16}$ and above) gave an improvement at the 2% level (Composition 16) and a further improvement at the 4% level (Composition 17), especially in soft water; Ninol P-621 (99% $C_{12}$ and $C_{14}$, 0.12% $C_{16}$ and above) was similar. The most narrow cut material, Ninol AA-62 Extra, containing substantially no $C_{16}$ and above material and 98.5% $C_{12}$ and $C_{14}$ material, gave even better hard water performance.

| | N | 14 | 15 | 16 | 17 | 18 | 19 |
|---|---|---|---|---|---|---|---|
| Sulphosuccinate | 20 | 20 | 20 | 20 | 20 | 20 | 20 |
| Dobanol 23-3A | 8 | 8 | 8 | 8 | 8 | 8 | 8 |
| Empilan CDE | — | 2 | 4 | — | — | — | — |
| LDEA | — | — | — | 2 | 4 | — | — |
| Ninol P-621 | — | — | — | — | — | 4 | — |
| Ninol AA-62 Extra | — | — | — | — | — | — | 4 |
| Urea | — | — | 12 | — | — | 12 | 12 |
| Total Active Detergent | 28 | 30 | 32 | 30 | 32 | 32 | 32 |
| LDA as % of a.d. | — | 6.7 | 12.5 | 6.7 | 12.5 | 12.5 | 12.5 |
| Cloud point (°C.) | — | — | −5 | — | — | −5 | −4 |
| Viscosity (cp) | — | — | 158 | — | — | 156 | 161 |
| Plates test 24° H | 32 | 33 | 31 | 34 | 35 | 35 | 38 |

-continued

| | N | 14 | 15 | 16 | 17 | 18 | 19 |
|---|---|---|---|---|---|---|---|
| 5° H | 38 | 42 | 40 | 44 | 47 | 44 | 46 |

EXAMPLE 20

A higher-concentration formulation (39% active detergent) was prepared using the $C_6/C_8$ dialkyl sulphosuccinate mixture of previous Examples and other ingredients as specified below:

| | 20 |
|---|---|
| Sulphosuccinate | 22.6 |
| Dobanol 13-3A | 11.3 |
| Ninol P-621 | 5.0 |
| (% of total a.d.) | (12.8) |
| Urea | 12.0 |
| Ethanol (as industrial methylated spirit) | 5.5 |

The composition was a stable homogeneous liquid having a cloud point of −2° C. and a viscosity of 87 cp.

EXAMPLES 21 and 22

This experiment shows how the substitution of a relatively high level of diethanolamide for the other detergent-active materials present, at constant active detergent level, leads to a substantial reduction in hydrotrope requirement. The results are shown in the following Table.

| | G | H | 21 | 22 |
|---|---|---|---|---|
| Sulphosuccinate | 16 | 16 | 12 | 12.5 |
| Dobanol 23-3A | 8 | 8 | 6 | 6.25 |
| Ninol P-621 | — | — | 6 | — |
| Empilan CDE | — | — | — | 6.25 |
| Urea | 10 | 12 | 8 | 6.5 |
| Ethanol | — | — | — | 1.0 |
| Total Active Detergent | 24 | 24 | 24 | 25 |
| LDA as % of a.d. | — | — | 25 | 25 |
| Cloud point (°C.) | −0.5 | −8 | −7 | <−5 |
| Viscosity (cp) | 156 | 138 | 325 | 183 |

The controls H and J, already discussed above in Examples 5 and 6, showed that the cloud point could be depressed by raising the urea level from 10 to 12%, but this did not improve the viscosity. Introduction of diethanolamide (Ninol P-621) to an extent of 25% of the active detergent system, at the same total active detergent level of 24%, not only depressed the cloud point and substantially raised the viscosity but also reduced the hydrotrope requirement to 8% (Composition 21). In Composition 22 the broader cut diethanolamide Empilan CDE was used at a very similar concentration level, with a mixed hydrotrope (alcohol and urea) system.

We claim:

1. A foaming liquid detergent composition in the form of a stable aqueous solution containing at least 15% by weight of an active detergent mixture consisting essentially of:

(a) a water-soluble salt of a dialkyl ester of sulphosuccinic acid in which the alkyl groups may be the same or different, (b) an alkyl ether sulphate and/or a polyethoxylated nonionic detergent, and (c) a $C_{10}$–$C_{18}$ carboxylic acid di($C_2$–$C_3$) alkanolamide, in an amount from about 5% but not exceeding 25% by weight of the active detergent mixture;

wherein the ratio of (a) to (b) is within the range of from 4:1 to 1:1, said (a), (b) and (c) constituting 100% by weight of the active detergent mixture.

2. The detergent composition of claim 1 wherein component (c) is a $C_{10}$–$C_{18}$ carboxylic acid diethanolamide.

3. The detergent composition of claim 2, wherein component (c) contains at least 75% by weight of $C_{12}$ and $C_{14}$ material and less than 1% by weight of $C_{16}$ and higher chain length material.

4. The detergent composition of claim 1, wherein the dialkyl sulphosuccinate (a) constitutes at least 5% of the total composition.

5. The detergent composition of claim 1, wherein the alkyl groups of the dialkyl sulphosuccinate (a) each have from 4 to 10 carbon atoms.

6. The detergent composition of claim 5, wherein the alkyl groups of the dialkyl sulphosuccinate (a) each have from 6 to 8 carbon atoms.

7. The detergent composition of claim 1, wherein component (b) comprises a $C_{10}$ to $C_{18}$ alkyl ether sulphate having an average degree of ethoxylation of from 1 to 12.

8. The detergent composition of claim 7, wherein component (b) comprises a primary alkyl ether sulphate containing less than 20% of material of chain length of $C_{14}$ and above and having an average degree of ethoxylation of from 1 to 12.

9. The detergent composition of claim 8, wherein the alkyl ether sulphate has an average degree of ethoxylation of from 1 to 8.

10. The detergent composition of claim 1, wherein component (b) comprises an ethoxylated nonionic detergent having an alkyl chain length of $C_8$ to $C_{15}$ and an average degree of ethoxylation of from 5 to 14.

11. The detergent composition of claim 1, wherein component (b) comprises a $C_{10}$–$C_{18}$ alkyl ether sulphate having an average degree of ethoxylation of from 1 to 12 and a $C_8$–$C_{15}$ ethoxylated nonionic detergent having an average degree of ethoxylation of from 5 to 14, in a weight ratio of at least 1:1.

12. The detergent composition of claim 1, which contains from 5 to 60% by weight of the active detergent mixture.

13. The detergent composition of claim 13, which contains from 5 to 40% by weight of the active detergent mixture.

* * * * *